US008807347B2

(12) United States Patent
Yui

(10) Patent No.: US 8,807,347 B2
(45) Date of Patent: Aug. 19, 2014

(54) PAPER PROCESSING APPARATUS

(75) Inventor: Akihiro Yui, Yokosuka (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 473 days.

(21) Appl. No.: 11/377,383

(22) Filed: Mar. 17, 2006

(65) Prior Publication Data

US 2007/0000819 A1 Jan. 4, 2007

(30) Foreign Application Priority Data

Jun. 17, 2005 (JP) ..... 2005-178064

(51) Int. Cl.
*B07C 5/00* (2006.01)

(52) U.S. Cl.
USPC ..... 209/534; 194/206; 194/207

(58) Field of Classification Search
USPC ..... 209/534, 552, 583; 194/206, 207, 194/210–217, 219, 224; 700/215, 221, 700/224–227
See application file for complete search history.

(56) References Cited

U.S. PATENT DOCUMENTS

| | | | | |
|---|---|---|---|---|
| 4,570,801 | A * | 2/1986 | Brannen | 209/534 |
| 4,830,742 | A * | 5/1989 | Takesako | 209/534 |
| 6,278,795 | B1 * | 8/2001 | Anderson et al. | 382/135 |
| 6,540,090 | B1 * | 4/2003 | Sakai et al. | 209/534 |
| 6,779,791 | B2 * | 8/2004 | Kawamura et al. | 271/228 |
| 2001/0028145 | A1 * | 10/2001 | Fukatsu et al. | 271/186 |
| 2002/0043560 | A1 | 4/2002 | Woods et al. | |
| 2002/0153291 | A1 * | 10/2002 | Otsuka | 209/534 |
| 2003/0057141 | A1 * | 3/2003 | Nomura | 209/534 |
| 2004/0154964 | A1 * | 8/2004 | Jones | 209/534 |
| 2005/0241909 | A1 * | 11/2005 | Mazur et al. | 194/207 |

FOREIGN PATENT DOCUMENTS

| | | |
|---|---|---|
| DE | 19810928 | 9/1999 |
| EP | 0317537 B1 | 5/1994 |
| EP | 1 211 207 A2 | 6/2002 |
| EP | 1 640 304 A2 | 3/2006 |
| GB | 2 104 877 A | 8/1982 |
| WO | WO 03/075228 | 9/2003 |

OTHER PUBLICATIONS

European Search Report dated Nov. 3, 2006 for Appln. No. 06007824.3-2314.
European Notice of Opposition dated May 5, 2010 for Appln. No. 06007824.3.
Giesecke & Devrient Selling Brochure "BPS 200—Desktop Banknote Processing System" pp. 1-8; 2002.

* cited by examiner

*Primary Examiner* — Joseph C Rodriguez
*Assistant Examiner* — Kalyanavenkateshware Kumar
(74) *Attorney, Agent, or Firm* — Oblon, Spivak, McClelland, Maier & Neustadt, L.L.P.

(57) ABSTRACT

A paper processing apparatus includes a setting section which sets a piece of paper, a feeding device which takes in the piece of paper set at this setting section, a transport device which transports the piece of paper took in by the feeding device, a judging section (detector) which discriminates whether or not the piece of paper transported by the transport device is a damaged note and discriminates types of damage and dirt of the piece of paper discriminated to be the damaged note, and a plurality of stacking boxes which carry out sorting and collection according to the types of damage and dirt discriminated by the judging section (detector).

10 Claims, 8 Drawing Sheets

Types of damage of damaged notes

| | |
|---|---|
| Taped note | |
| Corner folded note | |
| End face curled note | |
| Broken (cut or defected) note | |
| Wrinkled note | |
| Punched note | |

FIG. 4

Types of dirt of damaged notes

| | |
|---|---|
| Scribed note | |
| Wholly dirty note | |
| Partially dirty and / or stained note | |

FIG. 5

Sorting by types of damage and dirt of damaged

| | Note damage type | | | | | | Note dirt type | | |
|---|---|---|---|---|---|---|---|---|---|
| | Taped | Corner folded | End face curled | Broken | Punched | Wrinkled | Scribed | Wholly dirty | Partially dirty and / or stained |
| Stacking box 28 | Present | | | | | | | | |
| Stacking box 29 | | Present | | | | | | | |
| Stacking box 30 | | | Present | | | | | | |
| Stacking box 31 | | | | Present | Present | | | | |
| Stacking box 32 | | | | | | Present | | | |
| Stacking box 33 | | | | | | | Present | Present | Present |

FIG. 6A

Sorting by types of damage and dirt of damaged

| | Note damage type | | | | | | Note dirt type | | |
|---|---|---|---|---|---|---|---|---|---|
| | Taped | Corner folded | End face curled | Broken | Punched | Wrinkled | Scribed | Wholly dirty | Partially dirty and / or stained |
| Stacking box 28 | | | | | | | | | Present |
| Stacking box 29 | | | | | | | | Present | |
| Stacking box 30 | | | | | | | Present | | |
| Stacking box 31 | | | | | | Present | | | |
| Stacking box 32 | Present | | | Present | Present | | | | |
| Stacking box 33 | | Present | Present | | | | | | |

FIG. 6B

Sorting by type and level of damage and dirt of damaged

| | Type and level of damage of note | | | | | | Type and level of dirt of note | | |
|---|---|---|---|---|---|---|---|---|---|
| | Taped | Corner folded | End face curled | Broken | Punched | Wrinkled | Scribed | Wholly dirty | Partially dirty and / or stained |
| Stacking box 28 | — | Less than 3 mm | — | — | — | — | — | — | — |
| Stacking box 29 | — | From 3 mm to 10 mm | — | — | — | — | — | — | — |
| Stacking box 30 | — | 10 mm or more | | — | — | — | — | — | — |
| Stacking box 31 | — | — | 3 mm | — | — | — | — | — | — |
| Stacking box 32 | — | — | 3 mm or more | — | — | — | — | — | — |
| Stacking box 33 | Present | — | — | Present | Present | Present | Present | Present | Present |

FIG. 7A

Sorting by type and level of damage and dirt of damaged

| | Type and level of damage of note | | | | | | Type and level of dirt of note | | |
|---|---|---|---|---|---|---|---|---|---|
| | Taped | Corner folded | End face curled | Broken | Punched | Wrinkled | Scribed | Wholly dirty | Partially dirty and / or stained |
| Stacking box 28 | — | — | — | — | — | — | Less than 3 mm | — | — |
| Stacking box 29 | — | — | — | — | — | — | From 3 mm to 10 mm | — | — |
| Stacking box 30 | — | — | — | — | — | — | 10 mm or more | — | — |
| Stacking box 31 | — | — | — | — | — | — | — | — | Less than 2 mm in diameter |
| Stacking box 32 | — | — | — | — | — | — | — | — | 2 mm or more in diameter |
| Stacking box 33 | Present | Present | Present | Present | Present | Present | — | Present | — |

FIG. 7B

Sorting by type and level of damage and dirt of damaged note

| | Type and level of damage of note | | | | | | Type and level of dirt of note | | |
|---|---|---|---|---|---|---|---|---|---|
| | Taped | Corner folded | End face curled | Broken | Punched | Wrinkled | Scribed | Wholly dirty | Partially dirty and / or stained |
| Stacking box 28 | | | | | | | Less than 3 mm | | |
| Stacking box 29 | | | | | | | | | Less than 2 mm in diameter |
| Stacking box 30 | | | | | | | | Low dirt and damage level | |
| Stacking box 31 | | | | | | | | Middle dirt and damage level | 2 mm or more in diameter |
| Stacking box 32 | | | | | | | 3 mm or more | High dirt and damage level | |
| Stacking box 33 | Present | Present | Present | Present | Present | Present | —— | —— | —— |

FIG. 7C

Sorting by type and level of damage and dirt of damaged note

| | Type and level of damage of | | | | | | Type and level of dirt of note | | |
|---|---|---|---|---|---|---|---|---|---|
| | Taped | Corner folded | End face curled | Broken | Punched | Wrinkled | Scribed | Wholly dirty | Partially dirty and / or stained |
| Stacking box 28 | | 3 mm or less | 3 mm or less | | | | | | |
| Stacking box 29 | | 5 mm or more | 10 mm or more | | | | | | |
| Stacking box 30 | | | | | | | 5 mm or less | | |
| Stacking box 31 | | | | | | | | | 3 mm or less in diameter |
| Stacking box 32 | | | | | | | | Low dirt and damage level | |
| Stacking box 33 | Present | | | Present | Present | Present | | High dirt and damage level | |

FIG. 8A

Sorting by type and level of damage and dirt of damaged

| | Type and level of damage of note | | | | | | Type and level of dirt of note | | |
|---|---|---|---|---|---|---|---|---|---|
| | Taped | Corner folded | End face curled | Broken | Punched | Wrinkled | Scribed | Wholly dirty | Partially dirty and / or stained |
| Stacking box 28 | | Present | Present | | | | | | |
| Stacking box 29 | | | | Less than 3 mm | Less than 2 mm in diameter | | | | |
| Stacking box 30 | Present | | | 3 mm or more | 2 mm or more in diameter | | | | |
| Stacking box 31 | | | | | | | Less than 3 mm | | Less than 2 mm in diameter |
| Stacking box 32 | | | | | | | 3 mm or more | | 2 mm or more in diameter |
| Stacking box 33 | | | | | | Present | | Dirt and damage level | |

FIG. 8B

PAPER PROCESSING APPARATUS

CROSS-REFERENCE TO RELATED APPLICATIONS

This application is based upon and claims the benefit of priority from prior Japanese Patent Application No. 2005-178064, filed Jun. 17, 2005, the entire contents of which are incorporated herein by reference.

BACKGROUND OF THE INVENTION

1. Field of the Invention

The present invention relates to a paper processing apparatus for sorting and stacking paper money in a plurality of stacking boxes according to its type of money.

2. Description of the Related Art

A paper money processing apparatus of this type sets various sheets of paper (hereinafter, referred to as notes) at a setting section in a mixed state; feeds notes from this setting section on a one by one basis; judges its type of note, front/back, top or bottom, authentic/counterfeit, breakage or the like at a judging section; and sorts and stacks the notes in a plurality of stackers based on a result of the judgment.

In the meantime, conventionally, all notes other than those discriminated to be fit note at the judging section (detector) are stacked in a rejection box (hereinafter, referred to as a "reject stacker").

The notes to be stacked in such a reject stacker (hereinafter, referred to as a "rejected note") include: a taped note, a corner folded note, a cut note, a punched note, and a wrinkled note or the like. In addition, the rejected notes include a stained note, a wholly dirty note, and a scribed note or the like. Further, the rejected notes include: a note skewed due to transport performance; a plurality of notes fed due to feeding performance; or a counterfeit note and the like. A variety of these rejected notes are all collected in the reject stacker in their mixed state.

However, conventionally, in the case where a note quality is poor, a majority of the notes are transported to the reject stacker, the reject stacker becomes full immediately, and a process for removing a note from the reject stacker may be hard work for operator and not efficient. In this case, there is a problem that a feeding operation by a paper processing apparatus is stopped, and then, processing efficiency is lowered.

In addition, the rejected notes skewed due to the feeding and transporting performance or the rejected notes caused by the multiple feeding in a pile are often free of breakage or dirt on appearance, and are often supposed to be handled as fit notes. If such notes are collected in the reject stacker, the reject stacker together with poor quality notes becomes full immediately, and processing efficiency is lowered.

In addition, a fit note rejected in the rejected note is removed from the reject stacker, is set again at a feeding section, and is reprocessed.

However, in order to remove a fit note from the reject stacker, an operator must manually sort such a fit note to be classified from a damaged note or a counterfeit note. This sorting is cumbersome, and processing efficiency is extremely lowered.

On the other hand, a paper money processing apparatus has its own unique product standard for judging a corner folded note, a cut note, a punched note, a dirty note, and a taped note or the like, or alternatively, a criterion for discrimination is set by an operator. However, discrimination between a note to be void after being returned as a damaged note (unfit) to a central bank and note to be circulated again in a market is often made by a customer manually checking and sorting such a rejected note.

However, in addition to a note to be processed as a fit note and a counterfeit or the like, the reject stacker includes various types and dirt levels of damaged notes such as a corner folded note, a cut note, a punched note, a dirty note, and a taped note, and manual sorting is very cumbersome.

BRIEF SUMMARY OF THE INVENTION

An aspect of the present invention has been made in view of the above-described circumstances. It is an object of the present invention to provide a paper money processing apparatus capable of: sorting a note to be essentially handled as a fit note and a damaged note (unfit) from each other without a specific sorting work; sorting between a note to be void and a note to be circulated again; and further, storing and collecting a damaged note according to its breakage and its dirt type and level.

A paper processing apparatus according to one aspect of the present invention comprises: a setting section which sets a piece of paper; a feeding device which takes in the piece of paper set at this setting section; a transport device which transports the piece of paper took in by the feeding device; a judging device (detector) which discriminates whether or not the piece of paper transported by the transport device is a damaged note and discriminates types of damage and dirt of the piece of paper discriminated to be the damaged note; and a plurality of stacking boxes which carry out sorting and collection according to the types of damage and dirt discriminated by the judging device (detector).

A paper processing apparatus according to one aspect of the present invention comprises: a setting section which sets a piece of paper; a feeding device which takes in the piece of paper set at this setting section; a transport device which transports the piece of paper took in by the feeding device; a judging device (detector) which discriminates whether or not the piece of paper transported by the transport device is a damaged note and discriminates levels of damage and dirt of the piece of paper discriminated to be the damaged note; and a plurality of stacking boxes which carry out sorting and collection according to the levels of damage and dirt discriminated by the judging device.

A paper processing apparatus according to one aspect of the present invention comprises: a setting section which sets pieces of paper; a feeding device which takes in the piece of paper set at this setting section; a transport device which transports the piece of paper took in by the feeding device; a judging device (detector) which discriminates whether or not the piece of paper transported by the transport device is a damaged note and discriminates types and levels of damage and dirt of the piece of paper discriminated to be the damaged note; and a plurality of stacking boxes which carry out sorting and collection according to the types and the levels of damage and dirt discriminated by the judging device (detector).

A paper processing apparatus according to one aspect of the present invention comprises: a setting section which sets a piece of paper; a feeding device which takes in the piece of paper set at this setting section; a transport device which transports the piece of paper took in by the feeding device; a judging device (detector) which discriminates whether the piece of paper transported by the transport device is a fit note or a damaged note (unfit) and discriminates type of the piece of paper discriminated to be the fit note and types and levels of damage and dirt of the piece of paper discriminated to be the damaged note; and a plurality of stacking boxes which carry out sorting and collection according to the type of the piece of paper and the types and the levels of damage and dirt discriminated by the judging device.

A paper processing apparatus according to one aspect of the present invention comprises: a setting section which sets a piece of paper; a feeding device which takes in the piece of paper set at this setting section; a transport device which transports the piece of paper took in by the feeding device; a judging device (detector) which discriminates whether or not the piece of paper transported by the transport device has been damaged, skewed or fed in plurality; and a first stacking box which collects a piece of paper discriminated to be a damaged note by the judging device and a second stacking box which collects pieces of paper discriminated to be skewed or fed in plurality by the judging device.

According to the present invention, damaged notes are sorted and collected in a plurality of collecting stackers based on its breakage and its dirt type or degree (level). Thus, the sorting of the damaged notes can be automated without dependency on an operator's feeling, and sorting processing efficiency and sorting precision can be improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 4 is a view showing a type of damage of a damaged note (unfit) discriminated by the paper processing apparatus shown in FIG. 1;

FIG. 5 is a view showing a type of dirt of a damaged note (unfit) discriminated by the paper processing apparatus shown in FIG. 1;

FIG. 6A is a view showing a first example of sorting damaged notes;

FIG. 6B is a view showing a second example of sorting damaged notes;

FIG. 7A is a view showing a third example of sorting damaged notes;

FIG. 7B is a view showing a fourth example of sorting damaged notes;

FIG. 7C is a view showing a fifth example of sorting damaged notes;

FIG. 8A is a view showing a sixth example of sorting damaged notes; and

FIG. 8B is a view showing a seventh example of sorting damaged notes.

DETAILED DESCRIPTION OF THE INVENTION

Hereinafter, embodiments of the present invention will be described in detail with reference to the accompanying drawings.

Figure 1:
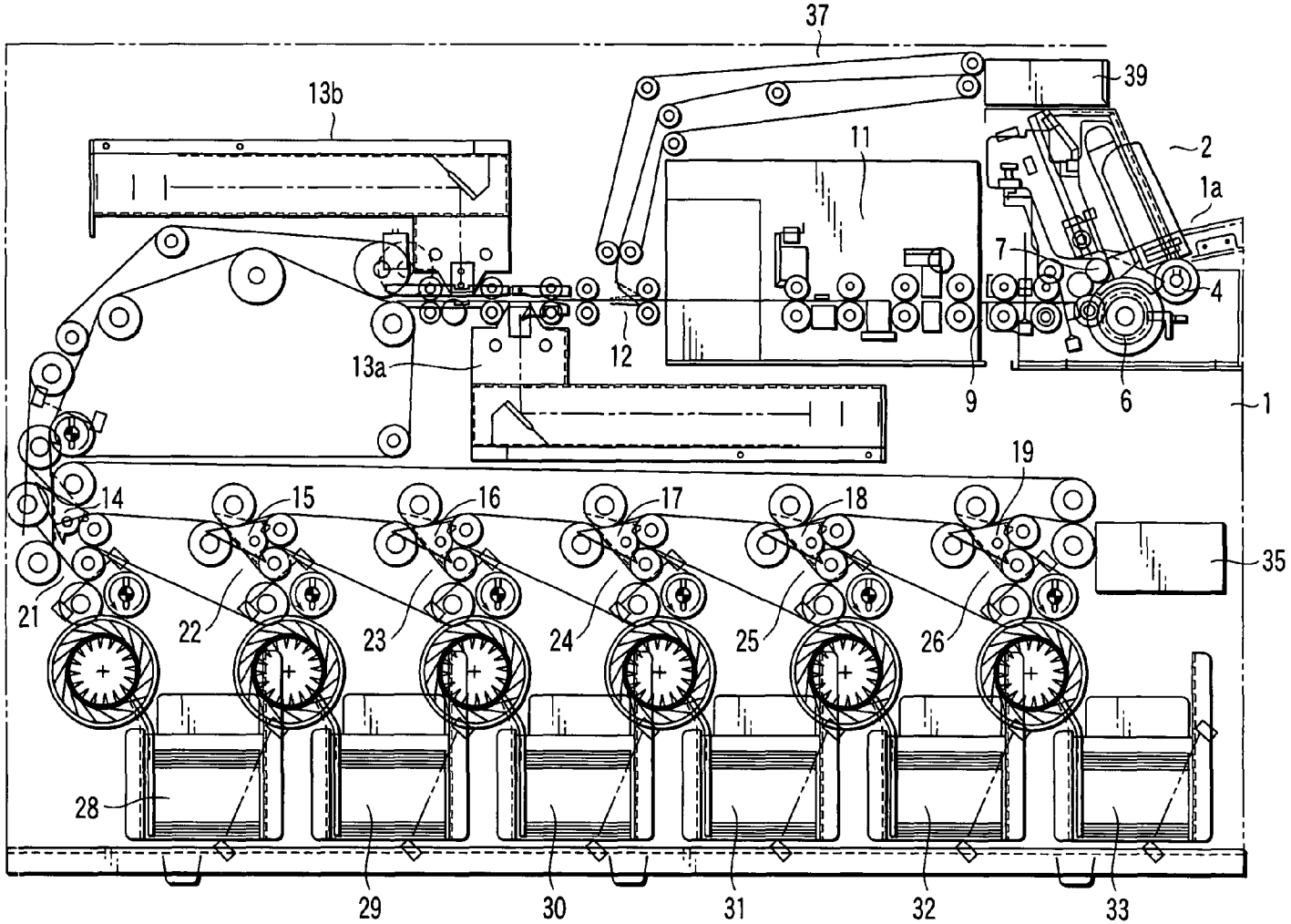
FIG. 1 is a structural view wholly showing a paper processing apparatus according to an embodiment of the present invention.

FIG. 1 is a schematic structural view showing a paper money processing apparatus serving as a paper processing apparatus according to an embodiment of the present invention.

In the figure, reference numeral 1 denotes an apparatus main body. A setting section 1*a* for setting paper money P serving as a piece of paper (hereinafter, referred to as a note) is provided at one side of this apparatus main body 1. The note P set at this setting section 1*a* is designed to be took in by a feeding section 2 serving as a feeding device. A take-in roller 4 is provided at the feeding section 2. In a note feeding direction of this capture roller 4, there are arranged a feed roller 6 and a separating roller 7 to be rolled in contact with the upper side of this feed roller 6.

The note P fed by the feed roller 6 is transported along a transport path 9 serving as a transport device. In the transport path 9, there are arranged: a first detector section 11 (optical system sensor section, thickness sensor section, magnetic sensor section); a sorting gate 12; a second sensor section 13*a*, 13*b* (CCD optical system sensor section); and first to sixth sorting gates 14 to 19.

The first detector section 11 (optical system sensor section, thickness sensor section, magnetic sensor section) optically and magnetically senses the shape and contents or the like of a note, and senses thickness or the like. The second detector section 13*a*, 13*b* has high resolution, is configured to have a CCD optical system which is deep in an object field depth, and detects a note with high precision.

The first to sixth sorting gates selectively guide a note to first to sixth branch paths 21 to 26. First to sixth stacking boxes (first stacking box) 28 to 33 serving as stacking boxes are arranged at a note ejection side of the first to sixth branch paths 21 to 26.

On the other hand, a counterfeit note stacking box 35 for collecting counterfeit notes is provided at the transport side of the transport path 9. In addition, a return stacker (second collecting stacker) 39 is provided at the above-described distributing gate 12 via a return path 37. The return stacker 39 is designed to collect notes rejected after being skewed or multiple fed in a pile.

Figure 2:
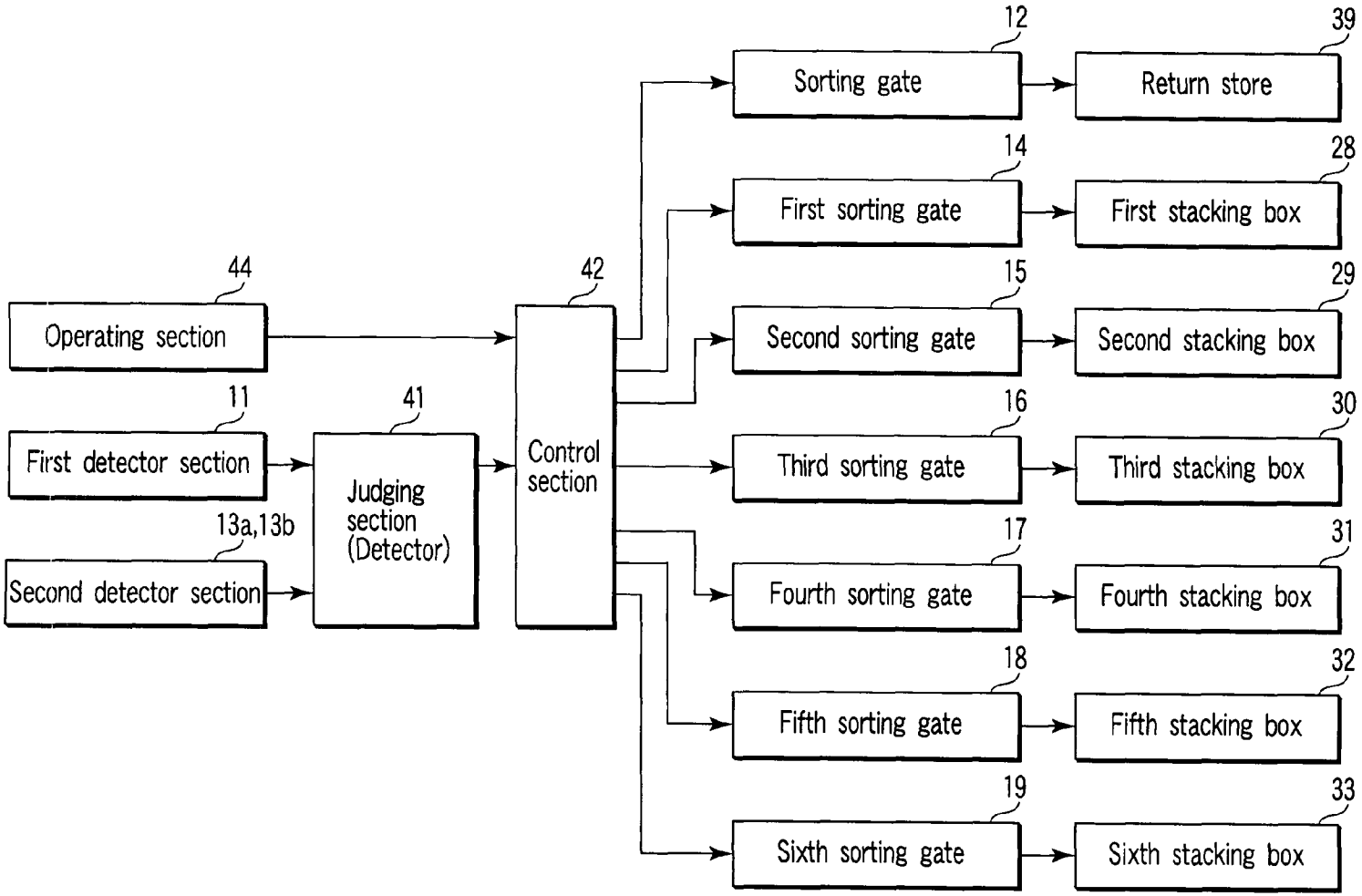
FIG. 2 is a block diagram depicting a drive control system of a sorting gate in the paper processing apparatus shown in FIG. 1.

FIG. 2 is a block diagram depicting a drive control system of the above-described sorting gate 12 and first to sixth sorting gates 14 to 19.

The above-described first and second detector sections 11, 13*a*, 13*b* are connected to a judging section 41 serving as a judging device via a transmitter circuit for transmitting a sense signal, and a control section 42 is connected to this judging section 41 via a transmitter circuit for transmitting a discrimination result. The sorting gate 12 and the first to sixth sorting gates 14 to 19 are connected to the control section 42 via a control circuit. In addition, an operating section 44 is connected to the control section 42 via a transmitter circuit.

The judging section 41 discriminates authenticity of a note based on detected information from the first detector section 11 and discriminates whether or not note is skewed or whether or not a plurality of notes are fed and transported. In addition, this judging section discriminates breakage based on detected information from the second detector section 13*a*, 13*b* and discriminates note breakage and dirt type, and further, level thereof.

Types of damage of damaged notes include: a taped note, a corner folded note, an end face curled note, a broken note, a punched note, and a wrinkled note or the like, as shown in FIG. 4.

Types of dirt of damaged notes include a scribed note, a wholly dirty note, and a partially dirty or stained note or the like, as shown in FIG. 5.

The levels of damage include: a size of corner folding or breakage in the case of a corner folded note or a damaged note; and a size of a punched diameter in the case of a punched note.

The levels of dirt include: a size of scribing in the case of a scribed note; a degree of dirt in the case of a wholly dirt note; and a size or the like of diameter dimensions of dirt or stain in the case of a partially dirty note or a stained note.

Figure 3:
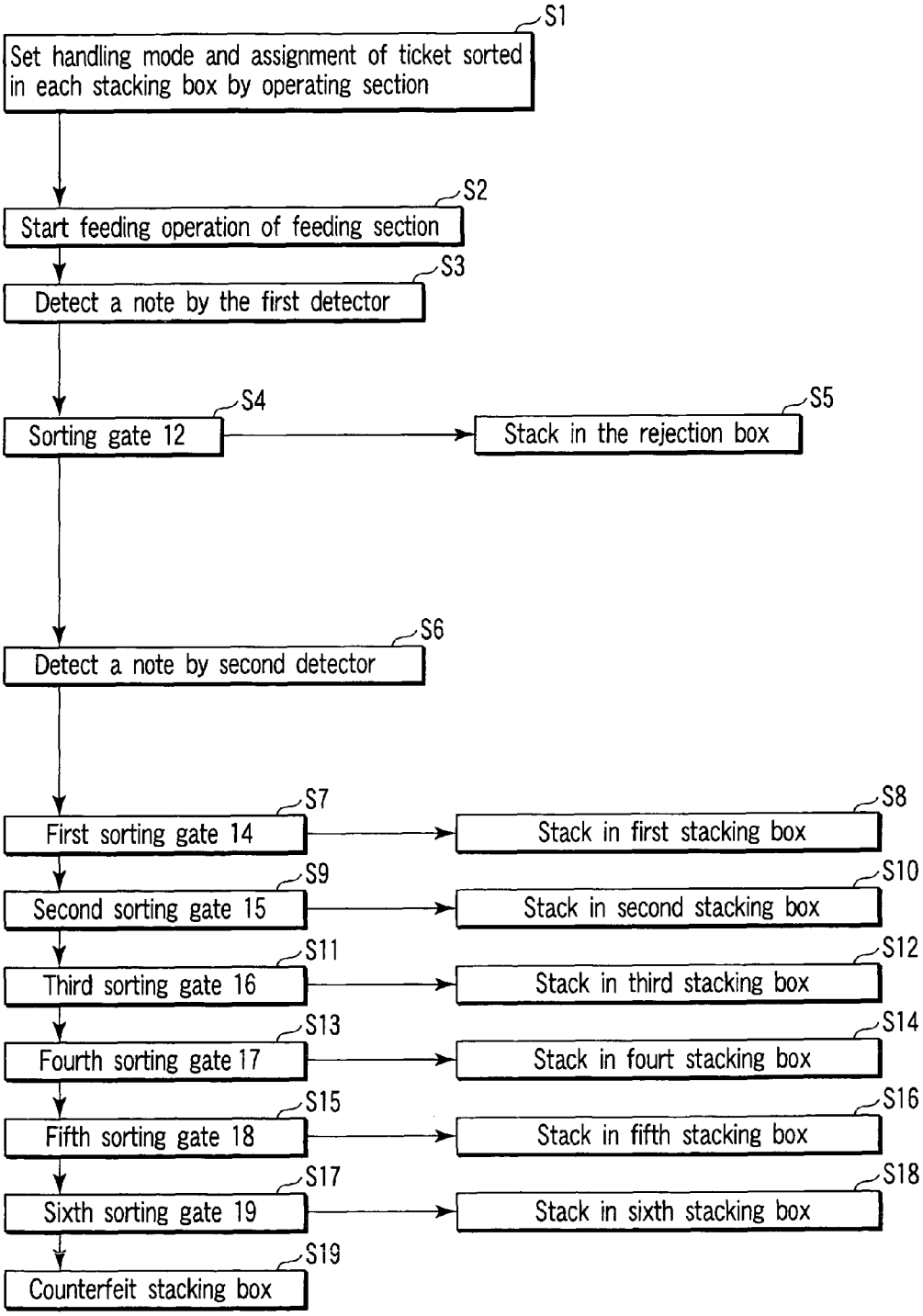
FIG. 3 is a flow chart showing a note sorting operation of the paper processing apparatus shown in FIG. 1.

A processing operation of the above-described paper money processing apparatus will be described with reference to a flow chart of FIG. 3.

First, the operating section (or PC) 44 sets a handling mode, for example, a fitness or unfitness category, and sets assignment of notes to be sorted into the stacking boxes 28 to 33 (step S1). In assignment, for example, the first to third stacking boxes 28 to 30 are used for fit notes, and the fourth to sixth stacking boxes 31 to 33 are used for damaged notes (unfit). Taped notes are set to be collected in the fourth stacking box 31; punched notes are set to be collected in the fifth stacking box 32; and scribed notes are set to be collected in the sixth stacking box 33.

After these settings, the take-in roller 4 of the feeding section 2 is rotated, and notes P are took in (step S2). These notes are fed after separated on a one by one basis by means of the feed roller 6 and the separating roller 7. The fed notes are transported along the transport path 9, and its shape and contents or the like are optically and magnetically sensed by means of the first detector section 11 and the thickness or the like is sensed by the same sensor (step S3). Based on this detected information, the authenticity of notes is discriminated at the judging section 41 and it is discriminated whether or not the notes are skewed or took in plurality. The notes discriminated to have been skewed or fed in plurality are distributed into the return path 37 by an operation of the distributing gate 12 (step S4), and the distributed notes are returned to the return stacker 39 via this return path 37 (step S5).

The notes discriminated to have not been skewed or multiple fed in a pile are transported to the second detector section 13*a*, 13*b* without being distributed by means of the sorting gate 12, and the fed notes are optically detected by the same sensor (step S6). Fitness or unfitness (damaged/dirty) is discriminated based on the detected information, and type and level of a damaged note is discriminated.

The notes discriminated to be fit notes are subjected to operation of the first to third sorting gates 14 to 16 for each note type (steps S7, S9, S11), and are collected to be sorted into the first to third stacking boxes 28 to 30 (step S8, S10, S12).

The notes discriminated to have been taped are subjected to operation of a fourth sorting gate 17 (step S13), and are collected to be sorted into a fourth stacking box 31 (step S14). The notes discriminated to have been punched are subjected to an operation of a fifth sorting gate 18 (step S15), and are collected to be sorted into a fifth stacking box 32 (step S16). The notes discriminated to have been scribed are subjected to an operation of a sixth sorting gate 19 (step S17), and are collected to be sorted into a sixth stacking box 33 (step S18).

In addition, in the case where the notes are discriminated to be counterfeit, such notes are transported to end of the transport path 9 without the operations of the first to sixth sorting gates 14 to 19, and the notes are collected in a counterfeit note stacking box 35 as they are (step S19).

In the above-described embodiments, the first to third stacking boxes 28 to 30 have been set so as to collect fit notes, and the fourth to sixth stacking boxes 31 to 33 have been set so as to collect damaged notes (unfit). The fourth stacking box 31 has been set so as to collect taped notes; the fifth stacking box 32 has been set so as to collect punched notes; and the sixth stacking box 33 has been set so as to collect scribed notes. Without being limited thereto, all of the first to sixth stacking boxes 28 to 33 may be set for damaged notes. For example, as shown in FIG. 6A, the first stacking box 28 may be set so as to collect taped notes; the second stacking box 29 may be set so as to collect corner folded notes; the third stacking box 30 may be set so as to collect end face curled notes; the fourth stacking box 31 may be set so as to collect damaged notes and punched notes; the fifth stacking box 32 may be set so as to collect wrinkled notes; and the sixth stacking box 33 may be set so as to collect scribed notes, wholly dirty notes, and partially dirty and/or stained notes, respectively.

In addition, as shown in FIG. 6B, the first stacking box 28 may be set so as to collect partially dirty and/or stained notes; the second stacking box 29 may be set so as to collect wholly dirt notes; the third stacking box 30 may be set so as to collect scribed notes; the fourth stacking box 31 may be set to collect wrinkled notes; the fifth stacking box 32 may be set so as to collect taped notes, broken notes, and punched notes; and the sixth stacking box 33 may be set so as to collect corner folded notes and end face curled notes or the like, respectively.

In addition, as shown in FIG. 7A, damaged notes may be collected to be sorted according to their quality and condition and breakage levels. That is, the first stacking box 28 may be set so as to sort and collect corner folded notes whose corner fold length is less than 3 mm; the second stocking box 29 may be set to sort and collect corner folded notes whose corner fold length ranges from 3 mm to 10 mm; the third stacking box 30 may be set to sort and collect corner folded notes whose corner fold length is 10 mm or more; the fourth stacking box 31 may be set to sort and collect end face curled notes whose curl length is less than 3 mm; the fifth stacking box 32 may be set to sort and collect end face curled notes whose curl length is 3 mm or more; and the sixth stacking box 33 may be set so as to collect taped notes, broken notes, punched notes, wrinkled notes, scribed notes, wholly dirty notes, and partially dirty and/or stained notes.

In addition, as shown in FIG. 7B, damaged notes may be collected to be sorted according to their dirt levels. That is, the first stacking box 28 may be set so as to collect scribed notes whose size of scribing is less than 3 mm; the second stacking box 29 may be set so as to collect scribed notes whose size of scribing ranges from 3 mm to 10 mm; the third stacking box 30 may be set so as to collect scribed notes whose size of scribing is 10 mm or more; the fourth stacking box 31 may be set so as to collect partially dirty and/or stained notes whose size of dirt is less than 2 mm; the fifth stacking box 32 may be set so as to collect partially dirty and/or stained notes whose size of dirt is 2 mm or more; and the sixth stacking box 33 may be set so as to collect taped notes, corner folded notes, end face curled notes, broken notes, punched notes, wrinkled notes, and wholly dirty notes.

In addition, as shown in FIG. 7C, the first stacking box 28 may be set so as to collect scribed notes whose size of scribing is less than 3 mm; the second stacking box 29 may be set so as to collect partially dirty and/or stained notes whose dirt or stain diameter is less than 2 mm; the third stacking box 30 may be set so as to collect wholly dirty notes whose dirt level is low; the fourth stacking box 31 may be set so as to collect wholly dirty notes whose dirt level is middle; the fifth stacking box 32 may be set so as to collect scribed notes whose size of scribing is 3 mm or more, wholly dirty notes whose dirt level is high, and partially dirty and/or stained notes whose dirt or stain diameter is 2 mm or more; and the sixth stacking box 33 may be set so as to collect taped notes, corner folded notes, end face curled notes, broken notes, punched notes, and wrinkled notes.

In addition, as shown in FIG. 8A, the first stacking box 28 may be set so as to collect corner folded notes whose length of corner fold is 3 mm or less and end face notes whose curl length is 3 mm or less; the second stacking box 29 may be set so as to connect corner folded notes whose corner fold length is 5 mm or more and end face curl notes whose curl length is 10 mm or more; the third stacking box 30 may be set so as to collect scribed notes whose size of scribing is 5 mm or less; the fourth stacking box 31 may be set so as to collect partially dirty and/or stained notes whose dirt and/or stain diameter is 3 mm or less; the fifth stacking box 32 may be set so as to collect wholly dirty notes whose dirt level is low; the sixth stacking box 33 are set so as to collect taped notes, broken notes, punched notes, wrinkled notes, and wholly dirty notes whose dirt level is high.

In addition, as shown in FIG. 8B, the first stacking box 28 may be set so as to collect corner folded notes and end surface curled notes; the second stacking box 29 may be set to collect broken notes whose breakage size is less than 3 mm and punched notes whose punched diameter is less than 2 mm; the third stacking box 30 may be set so as to collect taped notes, notes whose breakage size is 3 mm or more and punched notes whose punched diameter is 2 mm or more; the fourth stacking box 31 may be set so as to collect scribed notes whose size of scribing is less than 3 mm and partially dirty and/or stained notes whose dirt and/or stain diameter is less than 2 mm; the fifth stacking box 32 may be set so as to collect scribed notes whose size of scribing is 3 mm or more and partially dirty and/or stained notes whose dirt and/or stain diameter is 2 mm or more; and the sixth stacking box 33 may be set so as to collect wrinkled notes and wholly dirty notes whose dirt level is high.

As has been described above, according to the present embodiment, the judging section (detector) discriminates types and degrees of damage of damaged notes (taped note, corner folded note, cut note, end face curled note, broken note, punched note, or wrinkled note) and dirt types and degrees (scribed note, wholly dirty note, and partially dirty and/or stained note or the like), and damaged notes are automatically collected to be sorted in an arbitrary number of stacking boxes in accordance of the type and degrees of the damage and dirt, based on its discrimination result of judging section (detector). Accordingly, the discrimination/classification work considering the types of damaged notes can be significantly efficiently performed. Further, even in the case where many poor notes are handled, the frequency of the reject stacker becoming full is extremely decreased, and efficiency of machine operation and throughput is improved.

In addition, damaged notes are automatically collected to be sorted into an arbitrary number of stacking boxes according to its damage and dirt types and levels (degrees), based on the discrimination result of the judging section. Thus, notes to be returned as damaged notes (unfit note) to a central bank and the notes which can be circulated again in a market can be efficiently classified and a criterion for categories of damaged notes which have been judged by an operator's feeling can be quantitatively clarified, and sorting precision can be improved. The notes which can be circulated again in a market include: corner folded notes and end face curled notes which can be manually corrected by, for example, an operator; and slightly damaged or dirty notes.

In addition, a work of classifying fit note to be circulated again in a market or very clean notes (super fit) to be set at an ATM and automatic vending machine or the like can also be significantly efficiently carried out.

Further, note type sorting of fit note and sorting based on types and degrees (levels) of damage and dirt of damaged notes can be carried out by a single processing operation, and processing efficiency can be improved.

Furthermore, notes which should be essentially handled as fit notes, i.e., the notes rejected after skewed and multiple fed in a pile due to feeding and transporting performances are collected to be sorted from other rejected notes. Thus, there is no need for operator to sort notes in manual to be essentially discriminated to be fit notes and rejected notes, and no cumbersomeness occurs.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A currency processing machine having a transfer path, the currency processing machine comprising:

a feeding device for introducing notes to the transfer path;

a first detector located downstream of the feeding device along the transfer path, the first detector configured to detect whether any of the notes are skewed or multiply-fed;

a second detector located downstream of the first detector along the transfer path, the second detector configured to detect whether any of the notes have defects based on damage levels or dirt levels;

a gate structure positioned along the transfer path and interposed between the first detector and the second detector;

wherein, the gate structure is configured to direct notes detected to be skewed or multiply-fed by the first detector to a designated return stacking container positioned on a return path and to direct notes detected to have defects by the second detector to predetermined containers based on the damage level or dirt level of the defective notes.

2. The currency processing machine of claim 1, wherein the return stacking container is located on the return path upstream from the gate structure.

3. The currency processing machine of claim 1, wherein the first detector detects substantially damaged notes and the gate structure directs the substantially damages notes to the return stacking container.

4. A currency processing machine having a transfer path for conveying notes and component modules, the currency processing machine comprising:

a first detector module configured to detect whether any of the conveyed notes are skewed or multiply-fed;

a second detector module located downstream of the first detector module along the transfer path, the second detector module configured to detect whether any of the notes have defects based on damage levels or dirt levels;

a gate structure positioned along the transfer path and interposed between the first detector module and the second detector module;

a discriminator module communicatively coupled to the first detector module and the second detector, the discriminator module discriminating the notes based on information communicated by the first detector module and the second detector module, wherein, the gate structure directs notes discriminated as being skewed or multiply-fed to a designated return stacking container positioned on a return path and directs notes discriminated as having defects to predetermined containers in accordance with the damage level or dirt level of the defective notes.

5. The currency processing machine of claim 4, wherein the return stacking container is located on the return path upstream from the gate structure.

6. The currency processing machine of claim 4, wherein the first detector module detects substantially damaged notes and the gate structure directs the notes discriminated to be substantially damaged to the return stacking container.

7. A method for processing currency notes, comprising:

(a) feeding notes onto a transfer path;

(b) detecting, via a first detector, whether any of the notes fed onto the transfer path are skewed or multiply-fed;

(c) detecting, via a second detector located downstream of the first detector alone the transfer path, whether any of the notes have defects based on damage levels or dirt levels; and (d) directing, via a gate structure positioned along the transfer path and interposed between the first detector and the second detector, notes detected to be skewed or multiply-fed by the first detector to a designated return stacking portion and notes detected to have defects by the second detector to predetermined containers based on the damage level or dirt level of the defective notes.

8. The method of claim 7, wherein the return stacking portion is located on the return path upstream from the gate structure.

9. The method of claim 7, further comprising: (e) counting the notes having damage level or dirt level defects; and (f) authenticating the notes having the damage level or dirt level defects.

10. The method of claim 7, further comprising: detecting, by the first detector, substantially damaged notes and directing, by the gate structure, the substantially damaged notes to the return stacking portion.

* * * * *